US005771027A

United States Patent [19]

Marks et al.

[11] Patent Number: 5,771,027

[45] **Date of Patent: *Jun. 23, 1998**

[54] COMPOSITE ANTENNA

[75] Inventors: John Marks, Escondido; George Pynchon, Poway, both of Calif.

[73] Assignee: Composite Optics, Inc., San Diego, Calif.

[ * ] Notice: The term of this patent shall not extend beyond the expiration date of Pat. No. 5,440,801.

[21] Appl. No.: 847,864

[22] Filed: Apr. 28, 1997

Related U.S. Application Data

[60] Continuation of Ser. No. 487,486, Jun. 7, 1995, abandoned, which is a division of Ser. No. 205,879, Mar. 3, 1994, Pat. No. 5,440,801.

[51] Int. Cl.[6] ..... H01Q 1/38; H01Q 15/14

[52] U.S. Cl. ..... 343/912; 343/897; 29/600

[58] Field of Search ..... 343/912, 897, 343/873; 29/600, 601, 419.1; H01Q 1/36, 15/14

[56] References Cited

U.S. PATENT DOCUMENTS

| | | | |
|---|---|---|---|
| 2,742,387 | 4/1956 | Giuliani | 428/34.5 X |
| 2,805,974 | 9/1957 | Brucker | 428/116 X |
| 3,047,860 | 7/1962 | Swallow et al. | 343/897 |
| 3,078,461 | 2/1963 | Dwyer . | |
| 3,150,030 | 9/1964 | Mondano | 343/912 |
| 3,483,614 | 12/1969 | Kazimi . | |
| 3,496,617 | 2/1970 | Cook et al. . | |
| 3,716,869 | 2/1973 | Gould, Jr. et al. | 343/779 |
| 3,897,294 | 7/1975 | MacTurk . | |
| 3,993,528 | 11/1976 | Pauly . | |
| 4,001,836 | 1/1977 | Archer et al. | 343/756 |
| 4,092,453 | 5/1978 | Jonda | 343/897 |
| 4,171,563 | 10/1979 | Withoos . | |
| 4,191,604 | 3/1980 | MacTurk | 343/897 |
| 4,220,957 | 9/1980 | Britt | 343/756 |
| 4,263,598 | 4/1981 | Bellee et al. | 343/700 MS |
| 4,455,557 | 6/1984 | Thomas . | |
| 4,613,870 | 9/1986 | Stonier | 343/915 |
| 4,625,214 | 11/1986 | Parekh | 343/756 |
| 4,864,314 | 9/1989 | Bond | 343/700 MS |
| 4,926,189 | 5/1990 | Zaghloul et al. | 343/700 MS |
| 4,937,425 | 6/1990 | Chang et al. . | |
| 5,160,937 | 11/1992 | Fairies et al. | 343/781 P |
| 5,440,801 | 8/1995 | Marks et al. | 343/912 |

FOREIGN PATENT DOCUMENTS

| | | |
|---|---|---|
| 5167319 | 7/1993 | Japan . |
| 984482 | 2/1965 | United Kingdom . |

OTHER PUBLICATIONS

IBM Technical Disclosure Bulletin, vol. 6, No. 8, Jan. 1964, p. 99.

*Primary Examiner*—Hoanganh T. Le

*Attorney, Agent, or Firm*—Fulwider Patton Lee & Utecht, LLP

[57] ABSTRACT

A composite antenna and method for constructing same is disclosed. The composite antenna has a grid comprised of electrical conductors woven into the warp of a resin reinforced cloth forming one layer of the multi-layer laminate structure of the antenna.

14 Claims, 2 Drawing Sheets

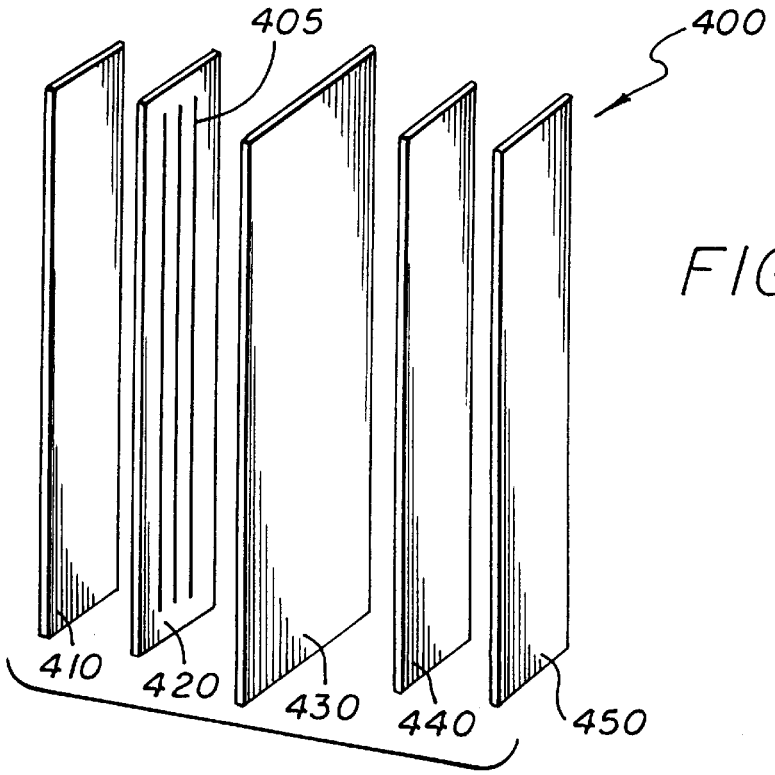
FIG. 5
FIG. 7
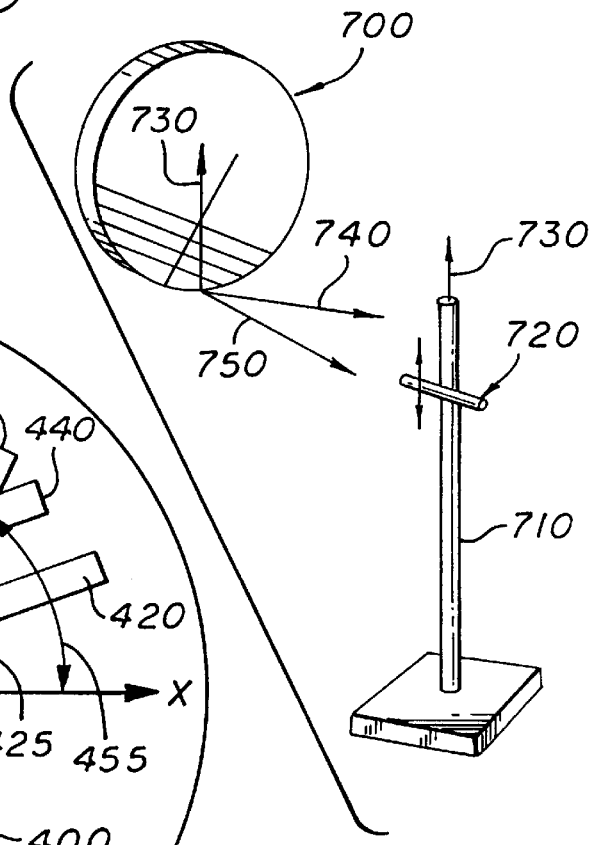
FIG. 6
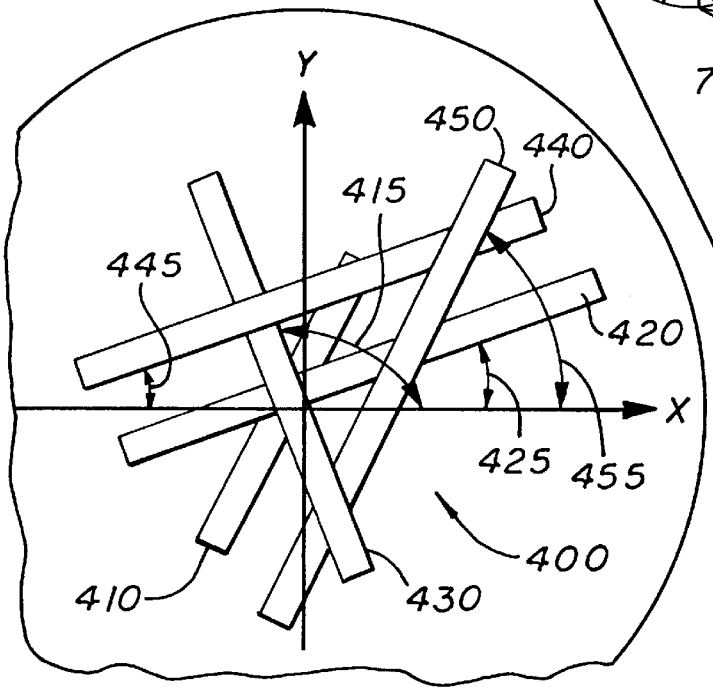

COMPOSITE ANTENNA

This application is a continuation of application Ser. No. 08/487,486, filed on Jun. 7, 1995, now abandoned which is a division of application Ser. No. 08/205,879, filed Mar. 3, 1994, now U.S. Pat. No. 5,440,801.

BACKGROUND OF THE INVENTION

1. Field of the Invention

This invention relates generally to antennas and more particularly to a novel composite antenna structure and method of construction.

2. Description of the Related Art

In general, the function of an antenna is to either radiate or receive electromagnetic energy. The structure of the antenna is dependent on the frequency or wavelength of the electromagnetic energy to be used, and also, in the case of a receiving antenna, on the strength of the signal when it reaches the antenna.

The characteristics of any electromagnetic signal can be described using two parameters. One parameter concerns the frequency or wavelength of the signal. Since frequency and wavelength are reciprocally related, specifying one necessarily infers the other; thus it is common to refer to antennas by the wavelength to be used, since this parameter is useful in determining the physical dimensions of the required antenna. The second parameter is the energy level to be radiated, or the strength of the signal to be received at the antenna.

These two parameters are required to design a suitable antenna. For example, antennas for use with long wavelengths having relatively low frequencies can simply be individual wires having a length of ¼ to ½ the wavelength of the electromagnetic energy. Electromagnetic energy in this region of the electromagnetic spectrum is not rapidly attenuated as it passes through the atmosphere and is also readily reflected by the ionosphere. Thus, signals of this type having relatively low power can be received over relatively great distances.

A disadvantage of signals of this type is that they are unfocused, carry relatively limited amounts of information, and are readily disrupted by atmospheric conditions or solar phenomenon. Thus, certain applications, such as signal transmission by geosynchronous communication satellites, require use of short wavelength, high frequency electromagnetic energy to penetrate the atmosphere and provide for long range communication. Other examples using electromagnetic energy in this range are microwave communication systems and various types of radar.

Electromagnetic energy is transmitted by causing the energy to be radiated from a suitable radiator. By its nature, electromagnetic energy radiates in a multidirectional fashion from a point source. This means that the total signal energy is dispersed in all directions, resulting in a relatively weak signal. This characteristic can be overcome by using extremely large, high power transmitters, radiating on the order of several thousands of watts of energy, as are commonly used for radio or television transmission.

Many applications, however, either require focused, unidirectional transmission patterns, or have structural or weight constraints that prohibit the use of heavy, high power transmitters. For example, most radar systems emit a focused beam of energy that is reflected by a target back to a receiver. The total weight of spacecraft and satellites are limited by the launch capacity of the launch vehicle, and thus cannot use heavy transmitters. Additionally, one result of point source radiation is that the electromagnetic waves diverge from the radiator. Thus, over great distances, this divergence results in a large attenuation of the strength of the signal when it finally encounters a receiver.

To overcome these obstacles, antenna structures have evolved to provide transmission of focused beams of electromagnetic energy. These same structures can also be used to concentrate weak signals to improve reception. One common structure known in the art is the reflecting dish antenna. In a structure of this type, the reflecting dish is shaped, much like a light reflecting mirror, so that it has a focal point. Energy emitted from the focal point is reflected in a concentrated beam; likewise, energy that falls upon the reflector is concentrated at the focal point. Thus, reflecting dish antennas commonly have a transmitter and/or a receiver located at the focal point of the dish.

The dish portion of the antenna can be fashioned from any material, as long as it incorporates a surface that will reflect the electromagnetic energy to be used. Early dish antennas were constructed entirely of metal. However, in applications where signal strength is very low and large reflecting surfaces are required, such structures are very heavy and cannot be used where weight is a factor. Therefore, it is common today to construct dish antennas having a shell fabricated from a rigid, but lightweight material, and then coating the surface with a thin layer of a reflecting metal, such as aluminum.

Another useful characteristic of electromagnetic waves is that they can be polarized. During polarization, the nature of the electromagnetic wave is altered so that the waves oscillate in only one direction, referred to as the polarizing angle. Antennas can be constructed that are sensitive to receiving energy oscillating in only one plane, with the portion of the wave out of the polarizing angle being highly attenuated. A polarizing dish antenna has a reflector that is not continuous, rather, it consists of a plurality of narrow reflective elements whose width and spacing depend on the selected wavelength to be received. This is particularly useful on a spacecraft, since a second lightweight shell, with a polarization grid oriented orthogonally to the grid of the first shell, can be used to transmit or receive a signal of different polarity at the same wavelength without interference. This essentially provides two antennas in the space required for one.

One antenna design frequently used is the parabolic reflecting dish antenna. The parabolic shape can be adjusted to radiate or receive a wide range of frequencies, and its aperture can be shaped to provide a specific radiation pattern. This is particularly useful on an orbiting communication satellite because it allows the antenna designer to tailor the "footprint" of the radiated beam to optimize transmission of the signal to the area of the earth's surface where reception of the signal is desired.

A parabolic dish is essentially a relatively thin walled structure having the shape of a parabola. The dish may be either symmetrical or non-symmetrical about its principle axis. A parabolic dish antenna comprises, essentially, a parabolic reflector and an antenna feed or receiver at the focal point of the reflector. Many different designs and methods of fabrication have been proposed for a variety of applications, ranging from antennas for mobil television relays to complex antennas used by communication satellites.

Parabolic antenna reflectors are commonly manufactured by first forming a core paraboloid having the desired shape.

The reflector is then added to the surface of the paraboloid. In a polarizing reflector antenna, the polarizing grid can be a separate piece situated in front of the reflector. This arrangement, however, requires a support structure for the grid, adding unnecessary weight, and precluding the arrangement of two reflectors to form a dual antenna as described above.

The polarizing grid can consist of thin, conductive strips oriented so that they are parallel when viewed along the focal axis of the antenna. The size and spacing of these strips depends upon the frequency of the radiation to be reflected. For example, an antenna designed for use at Ku Band frequencies (approximately 10–14 gigahertz) will have strips that are approximately 0.0003 inches thick, 0.003 inches wide, and spaced 0.02 inches apart.

One technique widely used to construct parabolic reflecting antennas incorporates the polarizing grid into the reflector surface. This polarizing reflecting surface is produced by using an array of narrow strips of a dielectric material cut into specific shapes that allow the strips, while manufactured as a flat sheet, to be configured in three dimensions as a paraboloid. This paraboloid is then adhered to a pre-formed parabolic-shaped core.

The narrow strips, typically 4–8 inches in width, are normally made of a non-conductive plastic such as Kapton (a registered trademark of the DuPont Corporation) and have conductive strips photo-etched from a copper layer plated on the Kapton surface. Since each strip must be unique to conform to the parabolic surface and to ensure that the conductive strips are parallel, the process is expensive and time consuming. One example of such a process is described in U.S. Pat. No. 4,001,836 (Archer et al.).

The requirement of, a separate dielectric strip array adds weight to the antenna, and may also affect the thermal expansion coefficient of the antenna. This is particularly disadvantageous for antennas used on communications satellites where total payload weight is a launch constraint and where the antenna will undergo extremes of temperatures as it moves from full sunlight into shadow while orbiting the earth. A parabolic core can be produced from an aramid fiber such as Kevlar (a registered trademark of the DuPont Corporation) having a coefficient of thermal expansion (CTE) of about one part per million per degree Fahrenheit (PPM/F). A low CTE is desirable because thermal distortions of the antenna reflector can limit the useful temperature range in which the antenna will function properly. With the present techniques, the addition of the Kapton strips can increase the CTE of the antenna reflector to 2–4 PPM/F. Co-curing the Kapton strips to the Kevlar core lowers the CTE to only 2–3 PPM/F, and adds further complication to the fabrication process. Thus, distortions caused by uneven heating of the antenna will be magnified, resulting in a reduction of receiver sensitivity and degradation of transmission beam patterns.

What has been needed, and heretofore unavailable, is a low cost method of producing a polarizing parabolic dish antenna that has an inherently low CTE with reduced weight and complexity of fabrication. The presently described invention fulfills this need.

SUMMARY OF THE INVENTION

The invention provides a novel composite antenna having a polarizing grid integrated into the laminated structure of the reflector. The grid is integrated into the structure of the reflector by weaving electrical conductors, for example, thin copper wires, into the warp of the resin reinforced cloth that is used to form one of the laminate layers of the reflector shell.

The invention overcomes the disadvantages of prior antennas by avoiding the necessity of separate construction of a grid element that must then be affixed to the reflector shell, resulting in a heavier structure with a higher coefficient of thermal expansion. Separate construction of the polarizing grid as used in previous antennas is more costly and adds weight and complexity to the antenna.

A novel method of forming the present invention is also disclosed. The structure of the present invention is constructed by first weaving a suitable cloth containing the electrical conductive elements of the polarizing grid. This cloth is used to form one layer of the laminated shell of the composite antenna by impregnating the cloth with a suitable resin, such as epoxy, and laying the cloth on a suitably shaped tool, thus incorporating the copper wires directly into the shell of the antenna. By using several properly oriented and precisely aligned layers of suitable cloth a composite polarizing antenna can be formed that is isotropically balanced, and minimizes any tendency of the laminate to bend under thermal loads. Also avoided is the need for expensive photo-masters, photo-etching of the conductors, construction of dielectric strips, and their adhesion to the shell.

These and other advantages of the invention will become more apparent from the following detailed description thereof when taken in conjunction with the accompanying exemplary drawings.

BRIEF DESCRIPTION OF THE DRAWINGS

FIG. 5 is an exploded perspective view of the various layers used to construct a polarizing parabolic dish antenna shell. For clarity, the layers are not depicted in their actual angular orientation relative to each other.

FIG. 6 is a plan view of a portion of the polarizing parabolic dish antenna of FIG. 2 depicting the cloth layers in their proper angular orientation.

FIG. 7 is a perspective view depicting a convex parabolic tool and a traveling telescope used during fabrication of the antenna to ensure proper orientation of the cloth strips.

DESCRIPTION OF THE PREFERRED EMBODIMENTS

It would be advantageous to provide a reliable, low cost, composite polarizing antenna with improved thermal stability for use on spacecraft. The present invention provides these advantages.

For the purposes of example, a composite polarizing antenna having a parabolic shape is described. It should be understood that such a parabolic shape is but one possible embodiment of the present invention, and that the structural details and methods of fabrication are equally applicable to any composite antenna. For example, the structure and method of the present invention may also be used to fabricate any shaped reflector, or may also be used to form flat panels that can be aggregated into a multifaceted reflector. Also, for clarity, like reference numbers will be used throughout the description when appropriate to assist in understanding the structure and method of fabrication of the composite antenna of the present invention.

Figure 1:
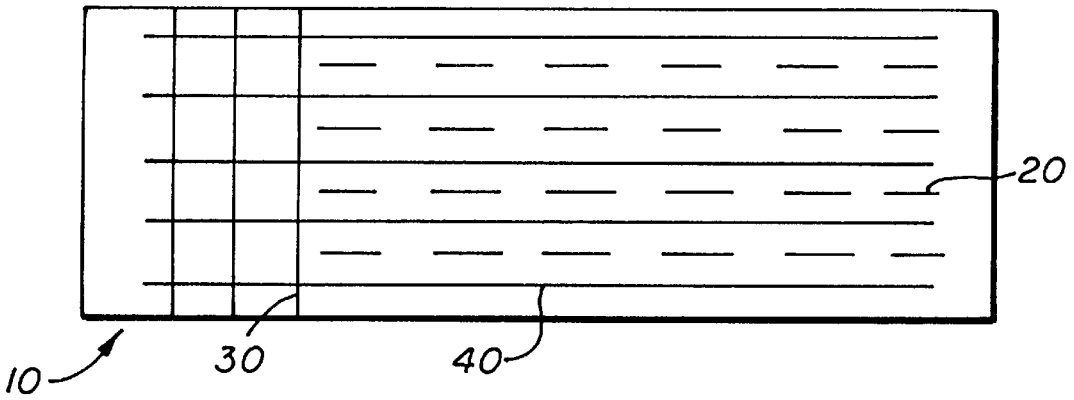
FIG. 1 is a plan view depicting a woven cloth strip having copper wires woven into the warp of the cloth.
Figure 2:
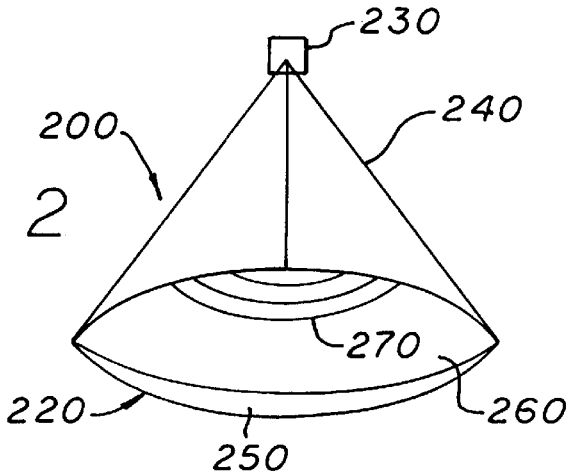
FIG. 2 is a perspective view depicting a polarizing parabolic dish antenna.

Turning first to FIG. 2, a polarizing parabolic dish antenna 200 is shown having a parabolic reflector 220 and an antenna feed 230 mounted in front of the reflector by means consisting of struts. This illustration is for example only; parabolic dish antennas can be constructed where the antenna feed is mounted off to one side of the parabolic reflector to remove the antenna feed from the illuminated area of the antenna. The geometry of the parabolic reflector is adjusted to provide a suitable illumination pattern when fed in this manner.

Additionally, the polarizing parabolic dish antenna 200 is shown having only one polarizing parabolic reflector 220 and antenna feed 230 for the sake of clarity in describing the present invention. Because the reflected signal is polarized along one plane, it is common to employ a second parabolic reflector oriented to provide a signal polarized 90° to the first signal. This allows a single antenna structure to provide two signals, thus saving considerable weight and complexity on a spacecraft. The present invention is particularly well suited to a dual polarized antenna application, as will be apparent from the following discussion. One example of such an antenna is disclosed in U.S. Pat. No. 4,625,214 (Parekh).

Contained within the structure of the rigid parabolic shell 250 is an electrically conductive polarizing grids 260 and 265 comprised of a plurality of electrical conductors 270 and 272. These electrical conductors 270 and 272 are, for example, copper wires woven into the warp of Kevlar cloth strips that form one layer of the laminate structure of the rigid parabolic shell 250. These electrical conductors 270 and 272 extend across the surface of the parabolic reflector 220 in planes parallel to one another and to the principal axis 310 of the reflector 220 with the electrical conductors 272 being oriented at a predetermined angle to electrical conductors 270.

Figure 3:
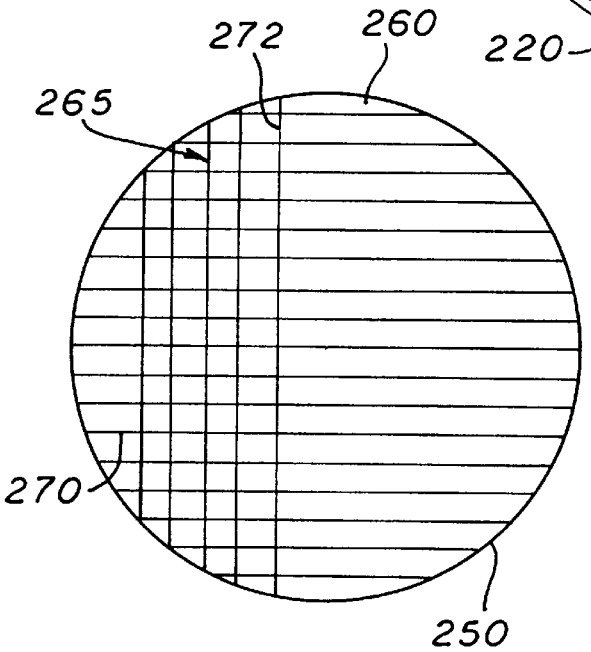
FIG. 3 is a plan view of the parabolic reflector of the antenna in FIG. 2.
Figure 4:
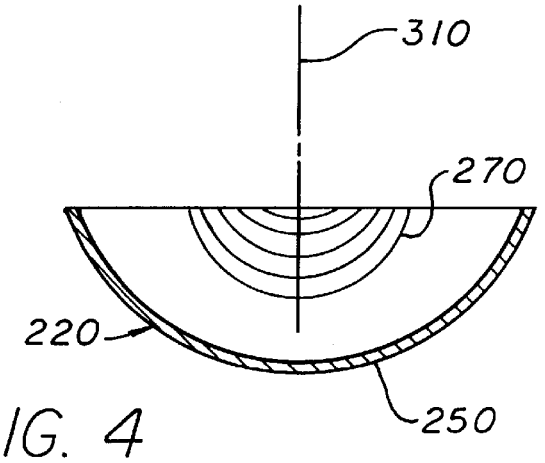
FIG. 4 is a cross-sectional view, taken along the line 3—3 of the parabolic reflector of FIG. 2.

FIG. 3 is a plan view of a rigid parabolic shell 250. In this view, the parallel orientation of the electrical conductors 270 forming the polarizing grid 260 is apparent. A cross-section taken along line 3—3 further illustrates this orientation and the relationship between the electrical conductors 270 and the principal axis 310 of the parabolic reflector 220.

As described previously, one prior art method of fabricating the polarizing grid consisted of photolithographically forming thin conductive strips on a separate dielectric sheet that was then precisely cut to match the surface of the parabolic shell. These strips were then glued onto the parabolic shell to form the reflector. In the present invention, the polarizing reflector is integrated into the parabolic shell by constructing the parabolic shell using strips of, for example, Kevlar fabric into which is woven, for example, copper wires. The Kevlar fabric is preferably woven of lightweight denier Kevlar 49 fiber in a plain weave. Other weave styles may be chosen to achieve design objectives but the plain weave conforms well to the antenna shape while maintaining the projected parallelism of the electrical conductors and the warp fibers. Kevlar is an E. I. Dupont registered trademark for a polyparabenzamide material. The copper wires 40 are interwoven among the warp of the cloth. The warp fibers 20 are those fibers which run in a primary, longitudinal direction. The secondary "fill" fibers 30 are orthogonally oriented relative to the warp fibers 20.

In one embodiment, the copper wires 40 are 0.002" in diameter and are woven 0.020" apart within the warp of the grid strips 10. This gives a reflector surface suitable for reflecting a Ku Band frequency of 10–14 gigahertz.

While this embodiment of the invention discloses use of Kevlar fiber and copper wires to form the grid strips 10, any dielectric yarn, such as fiberglass, or any other material having a low loss tangent and a suitable dielectric constant at the desired operating frequencies can be used. The electrical conductors 40 can be any metallic wire, a graphite tow, or a conductively coated dielectric yarn. This yarn may be identical to, or different from, the dielectric yarn used for the warp and fill of the grid strip 10. Thus, there is a wide range of fabric types and weights comprising a large number of combinations of yarn denier, warp and fill yarn counts per unit length and material types that are suitable matrixes for inclusion of the electrical conductive elements 40.

The polarizing parabolic reflector 220 embodiment of the present invention is constructed using typical lamination techniques used to fabricate multi-layer laminated articles. Because the polarizing parabolic dish antenna embodiment of the present invention is particularly suitable for use on spacecraft, careful attention must be made to selection of materials for the laminate layers, and their orientation relative to each other. It is important that the resulting structure be isotropically and thermally balanced. Isotropic balance is obtained when the laminate layers are oriented in a pattern 0°/+45°/−45°/90°. Thermal balance is obtained using laminate orientations that are symmetric about the mid-plane of symmetry of the laminate, and are balanced having an equal number of laminate plies oriented in pairs orthogonal to one another. Because of the pair-wise orthogonal orientation, the anisotropic thermal expansion behavior of individual laminate plies is canceled out, thus preventing warping due to temperature changes. This is particularly important when a composite structure such as the polarizing parabolic dish antenna embodiment of the present invention is employed on a spacecraft, given the great temperature differentials possible between the sunlit side of the spacecraft and the side that is in shadow. Thermal distortions of the polarizing parabolic dish antenna can cause degradation of signal quality, loss of efficiency, and misdirection of the signal beam. This may result in poor reception, or total loss of signal, by ground receiving stations.

Precise alignment of the grid strip 10 is necessary to achieve the high degree of linearity and parallelism of the electrical conductors 270 required to provide an efficient polarizing antenna. Incorporation of the electrical conductors 270 among the warp fibers 20 of the grid strip 10 allows use of a variety of inexpensive optical and mechanical methods to precisely align the strips by tracking the orientation of the cloth warp. Thus, the present invention may be used to form a polarizing dish antenna with a grid having linearity and parallelism equivalent to that attained with prior art methods, but at substantially reduced cost, weight and complexity.

A preferred method that can be used to construct the polarizing parabolic dish antenna embodiment of the present invention is described as follows. A convex parabolic tool with a focal length appropriately selected for the frequency of electromagnetic radiation to be reflected is machined from a suitable material such as bulk graphite. Tool marks to aid in orienting the laminate strips are machined into the surface of the convex parabolic tool.

The convex parabolic tool 700 is then mounted in relation to a traveling telescope 720 mounted on a tool base 710. This arrangement allows the traveling telescope 720 to be used to ensure alignment of the laminate strips when they are placed upon the convex parabolic tool 700. It, should be apparent to one skilled in the art that this arrangement allows fabrication of a polarizing parabolic reflector having any angle of polarization relative to the principle axis of the antenna. Thus, the construction method to be described is particularly useful in fabricating polarizing parabolic dish antennas that are intended to be used in a dual antenna arrangement, since the grid elements of each polarizing parabolic dish antenna are easily oriented orthogonal to each other.

By way of example, a polarizing parabolic dish antenna may be fabricated using the following types and orientation of laminates to produce a polarizing parabolic dish antenna that is thermally stable, isotropically balanced, and structurally adequate for use as a spacecraft antenna. As a first step, after the parabolic or the convex parabolic tool 700 and traveling telescope 720 have been arranged, the tool is rotated 20° about an axis parallel to the Z-axis 750. This alignment places the traveling telescope in a position relative to the convex parabolic tool such that rotation of the traveling telescope 720 about its X-axis allows it to scan the convex parabolic tool surface and locate the electrically conductive strips appropriately to produce a polarizing parabolic dish antenna having a 20° angle of polarization with respect to the X-axis. It will be obvious that another polarizing parabolic dish antenna can be produced having a polarization angle of 110° that can be mated with the antenna of the example to provide a dual antenna arrangement.

For purposes of example only, FIGS. 5 and 6 illustrate the laminate layers in their preferred respective orientations. This example of a polarizing parabolic dish antenna embodiment of the present invention is constructed from five plies of laminate. The first ply, in contact with the surface of the convex parabolic tool 700, consists of strips of 120 style Kevlar 49. Kevlar 49 is a high performance aramid fiber manufactured by Dupont and is commonly used in aerospace applications. Kevlar 49 has a tensile strength of approximately 450,000 PSI, a modulus of $18\times10^6$ PSI, and a density of 0.05 lbs.-per cubic inch. In this example, the 120 style Kevlar 49 cloth is impregnated with a matrix such as an epoxy. One advantage of using the Kevlar/epoxy composite is that it is virtually transparent to radio frequency signals which is particularly advantageous for use in a polarized antenna reflector. In this example, the conductive strips that will be laid up to form the grid ply will typically be 4–6 inches in width. This width is particularly advantageous because it allows the strips to be laid upon the convex parabolic tool 700 and aligned with minimal deformation in the warp filled plane. This 4–6 inch width is particularly suitable when constructing a parabolic reflecting antenna with a reflector aperture of 60–80 inches. It will be apparent that the dimensions of the strip can vary over a wide range with satisfactory results, limited only by the physical dimensions of the desired reflector aperture. The widths of the nonconductive layers can be considerably wider since exact warp alignment is less critical for these layers.

Using the convex parabolic tool 700 and traveling telescope 720 arrangement depicted in FIG. 7, the 120 style cloth 410 will be laid upon the convex parabolic tool 700 with the warp direction at 65° relative to the X-axis 730. This is accomplished by revolving the convex parabolic tool 65° about the Z-axis. As described previously, the traveling telescope 720 is then rotated about the X-axis 740, to scan the surface of convex parabolic tool 700. This scanning of the traveling telescope 720 across the surface of the tool allows each strip to be oriented properly. As strips are placed upon the surface of the tool, the traveling telescope is moved up and down the tool base 710 along the X-axis 740 so that the entire surface of convex parabolic tool 700 can be scanned. This process is repeated for each strip as each laminate layer is built up.

The second layer of the shell comprises the reflector grid. This grid is fabricated using strips of grid cloth 420 containing electrical conductors 405. As previously described, the electrical conductors are woven into the grid cloth 420 so that the electrical conductors 405 run parallel to the warp direction of grid cloth 420. In this example, grid cloth 420 is woven from 55 denier Kevlar 49 in a 50/50 plain weave in strips 4–6 inches wide. Copper wires 0.002 inches in diameter are woven parallel to the warp of the cloth and are placed 0.02 inches apart. These dimensions are suitable for producing a polarizing reflector useful for reflecting electromagnetic radiation in the Ku Band. These strips are laid on top the 120 style cloth 410 layer oriented 20° relative to the X-axis 730.

The next laminate layer consists of a honeycomb core 430 used to impart additional structural rigidity to the composite antenna. The honeycomb core 430 may be fabricated from a Kevlar fabric epoxy reinforced material, for example 120 style Kevlar cloth. The core comprises side by side ribbons of cloth, having an undulating shape, which are bonded to one another to form the hexagonal cells of a honeycomb, each cell having a length dimension orthogonal to the ribbon direction. The honeycomb core may be covered with a face sheet comprising two plies of Kevlar fabric with the warp running at an angle to the direction of the ribbons. These face sheets are aligned so that the honeycomb core is isotropically and thermally balanced.

The fourth laminate layer, identified herein as the type A layer 440, is made from the same cloth as the grid strip 420, with the exception that the copper wire electrical conductor 405 is not woven into the warp. This strip will be oriented with its warp at 20° relative to the X-axis. The final laminate ply consists of another layer of 120 style cloth 450 oriented with its, warp at 65° relative to the X-axis. Corresponding to current manufacturing practices, the aforementioned orientation angles have a tolerance of approximately +/−3°.

Once all the laminate layers are in place, the entire lay up is then cured under heat and pressure, resulting in a rigid shell having the desired structural and electrical properties. As previously mentioned, this entire process can be repeated with the orientation angles adjusted appropriately to provide another polarizing parabolic dish antenna with a polarization angle orthogonal to that of the exemplary antenna. These two polarizing parabolic dish antennas can then be combined in a dual antenna arrangement suitable for use on a spacecraft.

The composite antenna of the present invention may be used in any application requiring a low weight structure yet requiring excellent thermal stability. Furthermore, it should be understood that any dimensions associated with the above described embodiments are not intended to limit the invention to only those dimensions. For example, composite antennas designed to reflect electromagnetic energy at frequencies other than the aforementioned Ku Band will require different dimensions. Also, antennas for specific applications requiring specialized reflection patterns may also be constructed using the methods described herein. Furthermore, although the above embodiment describes a method for constructing polarizing parabolic dish antennas, the teachings are applicable to any shape of polarizing antennas.

Other modifications can be made to the present invention by those skilled in the art without departing from the scope thereof. While several forms of the invention have been illustrated and described, it will also be apparent that various modifications can be made without departing from the spirit and scope of the invention. Accordingly, it is not intended that the invention be limited, except as by the appended claims.

We claim:

1. A composite antenna, comprising:

a rigid shell forming an antenna aperture and having a plurality of layers of resin reinforced cloth, the cloth having a plurality of warp fibers interwoven with a plurality of fill fibers; and a plurality of electrical conductors woven into the warp of at least one of said layers of resin reinforced cloth, the conductors being separated from each adjacent conductor, the number of the plurality of electrical conductors woven into the warp of the at least one said layer of resin reinforced cloth being less than the number of warp fibers in the cloth.

2. The composite antenna of claim 1, wherein said layers of resin reinforced cloth comprise strips having a width dimension, said width dimension being determined by the width of the aperture of said composite antenna.

3. The composite antenna of claim 1, wherein said electrical conductors are arranged essentially parallel to each adjacent electrical conductor.

4. The composite antenna of claim 1, wherein said electrical conductors are copper wires.

5. The composite antenna of claim 1, wherein said resin reinforced cloth is impregnated with a thermosetting resin.

6. The composite antenna of claim 1, wherein said rigid shell has a parabolic shape.

7. The composite antenna of claim 1, wherein said grid is a polarizing reflector.

8. A composite antenna, comprising:

a rigid shell comprised of a laminated structure having a plurality of layers of resin reinforced cloth arranged in a pair-wise fashion, the cloth having a plurality of warp fibers interwoven with a plurality of fill fibers;

a first grid comprised of a plurality of electrical conductors woven between at least one pair of the plurality of warp fibers of a layer of the plurality of layers of resin reinforced cloth, said electrical conductors being arranged essentially parallel to the warp fibers of the cloth and parallel to and separated from each adjacent electrical conductor of the first grid by a predetermined distance, the number of the plurality of electrical conductors being less than the plurality of warp fibers; and a second grid comprised of a plurality of electrical conductors woven between at least one pair of the plurality of warp fibers of a second layer of the plurality of layers of resin reinforced cloth, said electrical conductors being arranged parallel to the warp fibers of the cloth and parallel to and separated from each adjacent electrical conductor of the second grid by a predetermined distance, the number of the plurality of electrical conductors being less than the plurality of warp fibers, said first and second grids oriented at a predetermined angle to one another and separated from one another by a layer of non-conductive material.

9. The composite antenna of claim 8 wherein said composite antenna structure is parabolic in shape.

10. The composite antenna of claim 8 wherein said layers of resin reinforced cloth are impregnated with a thermosetting resin.

11. The composite antenna of claim 8 wherein said layers of resin reinforced cloth are comprised of narrow strips of said resin reinforced cloth.

12. The composite antenna of claim 8 wherein said electrical conductors are copper wires.

13. The composite antenna of claim 8 wherein the non-conductive layer separating the first and second grids comprises one of the plurality of layers of resin reinforced cloth.

14. The composite antenna of claim 8 wherein the non-conductive layer separating the first and second grids comprises a honeycomb composite material.

* * * * *